US008395304B2

(12) United States Patent
Hisayasu et al.

(10) Patent No.: US 8,395,304 B2
(45) Date of Patent: Mar. 12, 2013

(54) LAMP AND LIGHTING EQUIPMENT WITH THERMALLY CONDUCTIVE SUBSTRATE AND BODY

(75) Inventors: Takeshi Hisayasu, Yokosuka (JP); Kazuto Morikawa, Yokosuka (JP); Yusuke Shibahara, Yokosuka (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 194 days.

(21) Appl. No.: 12/888,921

(22) Filed: Sep. 23, 2010

(65) Prior Publication Data

US 2011/0074271 A1 Mar. 31, 2011

(30) Foreign Application Priority Data

Sep. 25, 2009 (JP) ..... 2009-220433

(51) Int. Cl.
*H01J 61/52* (2006.01)

(52) U.S. Cl. ..... 313/46; 362/547; 362/249.02

(58) Field of Classification Search ..... 313/46; 362/294

See application file for complete search history.

(56) References Cited

U.S. PATENT DOCUMENTS

| | | | |
|---|---|---|---|
| 1,972,790 | A | 9/1934 | Olley |
| 4,355,853 | A | 10/1982 | Kourimsky |
| 4,503,360 | A | 3/1985 | Bedel |
| 4,630,182 | A | 12/1986 | Moroi |
| 4,939,420 | A | 7/1990 | Lim |
| 5,327,332 | A | 7/1994 | Hafemeister |
| D356,107 | S | 3/1995 | Watanabe et al. |
| 5,537,301 | A | 7/1996 | Martich |
| 5,556,584 | A | 9/1996 | Yamazaki |
| 5,585,697 | A | 12/1996 | Cote |
| 5,632,551 | A | 5/1997 | Roney |
| 5,775,792 | A | 7/1998 | Wiese |
| 5,785,418 | A | 7/1998 | Hochstein |

(Continued)

FOREIGN PATENT DOCUMENTS

| | | |
|---|---|---|
| CN | 101307887 | 11/2008 |
| DE | 10 2004 042186 | 3/2006 |

(Continued)

OTHER PUBLICATIONS

English Language Abstract of JP 2001-243809, published Sep. 7, 2001.

(Continued)

*Primary Examiner* — Tracie Y Green

(74) *Attorney, Agent, or Firm* — DLA Piper LLP (US)

(57) ABSTRACT

In one embodiment, a lamp includes a thermal conductive hollow base body having a concave container portion, an opening portion formed at one end portion so as to communicate with the container portion and a substrate support portion formed at a peripheral portion of the opening portion. A substrate is formed of one of a thermal conductive metal plate and a thermal conductive insulating plate and including a semiconductor lighting element mounted on one surface. A peripheral portion of the other surface of the substrate is fixed to the substrate support portion so as to cover the opening portion in a thermally conductive state therebetween. A power supply device is accommodated in the container portion of the base body to light on the semiconductor lighting element. A base is provided at the other end portion side of the base body and electrically connected with the power supply device.

23 Claims, 6 Drawing Sheets

U.S. PATENT DOCUMENTS 5,857,767 A 1/1999 Hochstein
5,947,588 A 9/1999 Huang
6,095,668 A 8/2000 Rykowski et al.
6,161,910 A 12/2000 Reisenauer
6,186,646 B1 2/2001 Wiedemer
6,227,679 B1 5/2001 Zhang et al.
6,234,649 B1 5/2001 Katougi
6,294,973 B1 9/2001 Kimura
6,502,968 B1 1/2003 Simon
6,517,217 B1 2/2003 Liao
6,525,668 B1 2/2003 Petrick
6,598,996 B1 7/2003 Lodhie
6,641,283 B1 11/2003 Bohler
6,787,999 B2 9/2004 Stimac et al.
D497,439 S 10/2004 Shaw et al.
6,814,470 B2 11/2004 Rizkin et al.
6,936,855 B1 8/2005 Harrah
6,948,829 B2 9/2005 Verdes et al.
6,982,518 B2 1/2006 Chou et al.
7,059,748 B2 6/2006 Coushaine
7,074,104 B2 7/2006 Itaya
7,111,961 B2 9/2006 Trenchard
7,125,146 B2 10/2006 Willis
7,144,140 B2 12/2006 Sun et al.
D534,665 S 1/2007 Egawa et al.
D535,038 S 1/2007 Egawa et al.
7,165,866 B2 1/2007 Li
7,198,387 B1 4/2007 Gloisten et al.
7,226,189 B2 6/2007 Lee et al.
7,281,818 B2 10/2007 You
7,300,173 B2 11/2007 Catalano
7,329,024 B2 2/2008 Lynch
7,331,689 B2 2/2008 Chen
7,347,589 B2 3/2008 Ge
7,431,477 B2 10/2008 Chou et al.
7,497,596 B2 3/2009 Ge
7,631,987 B2 12/2009 Wei
7,679,096 B1 3/2010 Ruffin
7,758,223 B2 7/2010 Osawa et al.
7,824,075 B2 11/2010 Maxik
7,919,339 B2 4/2011 Hsu
7,947,596 B2 5/2011 Takeda
7,963,686 B2 * 6/2011 Hu ..... 362/547
8,058,784 B2 11/2011 Treurniet
8,066,417 B2 * 11/2011 Balazs et al. ..... 362/555
2002/0012246 A1 1/2002 Rincover et al.
2002/0024814 A1 2/2002 Matsuba
2002/0195918 A1 12/2002 Matsuba et al.
2003/0063476 A1 4/2003 English et al.
2003/0117797 A1 6/2003 Sommers et al.
2003/0117801 A1 6/2003 Lin
2003/0137838 A1 7/2003 Rizkin et al.
2003/0151917 A1 8/2003 Daughtry
2004/0012955 A1 1/2004 Hsieh
2004/0109310 A1 6/2004 Galli
2004/0120156 A1 6/2004 Ryan
2004/0145898 A1 7/2004 Ase et al.
2004/0156191 A1 8/2004 Biasoli
2004/0218385 A1 11/2004 Tomiyoshi
2005/0007772 A1 1/2005 Yen
2005/0024864 A1 2/2005 Galli
2005/0068776 A1 3/2005 Ge
2005/0073244 A1 4/2005 Chou et al.
2005/0111234 A1 5/2005 Martin et al.
2005/0162864 A1 7/2005 Verdes et al.
2005/0174769 A1 8/2005 Yong
2005/0243552 A1 11/2005 Maxik
2005/0254246 A1 11/2005 Huang
2006/0043546 A1 3/2006 Kraus
2006/0092640 A1 5/2006 Li
2006/0193130 A1 8/2006 Ishibashi
2006/0193139 A1 8/2006 Sun
2006/0198147 A1 9/2006 Ge
2006/0215408 A1 9/2006 Lee
2006/0219428 A1 10/2006 Chinda et al.
2006/0227558 A1 * 10/2006 Osawa et al. ..... 362/351
2006/0239002 A1 10/2006 Chou et al.
2007/0002570 A1 1/2007 Souza
2007/0041182 A1 2/2007 Ge et al.
2007/0096114 A1 5/2007 Aoki
2007/0103904 A1 5/2007 Chen
2007/0279903 A1 12/2007 Negley
2008/0002100 A1 1/2008 Kaneko
2008/0006911 A1 1/2008 Nakahara et al.
2008/0037255 A1 2/2008 Wang
2008/0084701 A1 4/2008 Van De Ven
2008/0112170 A1 5/2008 Trott
2008/0130298 A1 6/2008 Negley
2008/0173883 A1 7/2008 Hussell
2008/0289867 A1 11/2008 Owens
2009/0059595 A1 3/2009 Ge
2009/0116229 A1 5/2009 Dalton
2009/0116231 A1 5/2009 Miller
2009/0175041 A1 7/2009 Yuen et al.
2009/0184616 A1 7/2009 Van de Ven
2009/0184646 A1 7/2009 Devaney
2009/0207602 A1 8/2009 Reed
2009/0294780 A1 12/2009 Chou
2010/0026157 A1 2/2010 Tanaka
2010/0060130 A1 * 3/2010 Li ..... 313/46
2010/0067241 A1 * 3/2010 Lapatovich et al. ..... 362/361
2010/0096992 A1 4/2010 Yamamoto
2010/0315442 A1 4/2010 Otto
2010/0207534 A1 8/2010 Dowling
2010/0219735 A1 9/2010 Sakai et al.
2010/0225220 A1 9/2010 Tanaka et al.
2010/0237761 A1 9/2010 Osawa et al.
2010/0237779 A1 9/2010 Osawa et al.
2010/0244650 A1 9/2010 Osawa et al.
2010/0244694 A1 9/2010 Osawa et al.
2010/0253200 A1 10/2010 Osawa et al.
2010/0277082 A1 11/2010 Reed
2010/0289396 A1 11/2010 Osawa
2010/0327746 A1 12/2010 Hisayasu
2010/0327751 A1 12/2010 Takenaka et al.
2011/0025206 A1 2/2011 Hiramatsu et al.
2011/0063842 A1 3/2011 Takei et al.
2011/0068674 A1 3/2011 Takenaka et al.
2011/0074269 A1 3/2011 Hisayasu et al.
2011/0074290 A1 3/2011 Sakai et al.
2011/0074291 A1 3/2011 Osawa et al.
2011/0079814 A1 4/2011 Chen
2011/0089806 A1 4/2011 Suwa et al.
2011/0139491 A1 6/2011 Chang
2011/0156569 A1 6/2011 Osawa

FOREIGN PATENT DOCUMENTS

DE 20 2008 016 231 4/2009
EP 1705421 9/2006
EP 2037633 3/2009
EP 2149742 2/2010
EP 2 163 808 3/2010
JP 57-152706 9/1982
JP 59-035303 2/1984
JP 61-35216 2/1986
JP 62-190366 12/1987
JP 63-5581 1/1988
JP 63-102265 5/1988
JP 64-7204 1/1989
JP 1-206505 8/1989
JP 2-91105 3/1990
JP 2000-083343 3/2000
JP 2000-173303 6/2000
JP 2001-243809 9/2001
JP 2002-525814 8/2002
JP 2002-280617 9/2002
JP 2003-016808 1/2003
JP 2003-059305 2/2003
JP 2003-59330 2/2003
JP 2003-92022 3/2003
JP 2004-6096 1/2004
JP 2004-119078 4/2004
JP 2004-193053 7/2004
JP 2004-221042 8/2004
JP 2005-93097 4/2005
JP 2005-123200 5/2005
JP 2005-513815 5/2005

| | | |
|---|---|---|
| JP | 2005-166578 | 6/2005 |
| JP | 2005-286267 | 10/2005 |
| JP | 2006-040727 | 2/2006 |
| JP | 3121916 | 5/2006 |
| JP | 2006-156187 | 6/2006 |
| JP | 2006-244725 | 9/2006 |
| JP | 2006-310057 | 11/2006 |
| JP | 2006-313717 | 11/2006 |
| JP | 2006-313718 | 11/2006 |
| JP | 2007-073306 | 3/2007 |
| JP | 2007-188832 | 7/2007 |
| JP | 2007-207576 | 8/2007 |
| JP | 2008-027910 | 2/2008 |
| JP | 2008-91140 | 4/2008 |
| JP | 2008-227412 | 9/2008 |
| JP | 2008-277561 | 11/2008 |
| JP | 2009-37995 | 2/2009 |
| JP | 2009-117342 | 5/2009 |
| JP | 2009-135026 | 6/2009 |
| JP | 2009-206104 | 8/2009 |
| WO | WO 03/056636 | 7/2003 |
| WO | WO 2005/024898 | 3/2005 |
| WO | WO 2006/118457 | 11/2006 |
| WO | WO 2008/146694 | 12/2008 |
| WO | WO 2009/087897 | 7/2009 |

OTHER PUBLICATIONS

English Language Abstract of JP Publication 01-206505 published Aug. 18, 1989.
English Language Abstract of JP Publication 2005-093097 published Apr. 7, 2005.
English Language Abstract of JP Publication 2005-123200 published May 12, 2005.
English Language Abstract of JP 2006-313718, published Nov. 16, 2006.
English Language Abstract of JP Publication 63-005581 published Jan. 11, 1988.
English Language Abstract of JP Publication 64-007402 published Jan. 11, 1989.
English Language Machine Translation of JP 2000-083343; published Mar. 21. 2000.
English Language Machine Translation of JP 2000-173303 published Jun. 23, 2000.
English Language Machine Translation of JP 2001-243809, published Sep. 7, 2001.
English Language Machine translation of JP 2003-59330 published Feb. 28, 2003. .
English Language Machine Translation of JP 2004-006096 published Jan. 8, 2004
English Language Machine Translation of JP 2004-193053 published Jul. 8, 2004.
English Language Machine Translation of JP 2005-166578 published Jun. 23, 2005.
English Language Machine translation of JP 2005-513815 published May 12, 2005.
English Language Machine translation of JP 2006-040727 published Feb. 9, 2006.
English Language Machine Translation of JP 2006-310057, published Nov. 9. 2006.
English Language Machine Translation of JP 2006-313718, published Nov. 16, 2006.
English Language Machine translation of JP 2008-91140 published Apr. 17, 2008.
English Language Machine Translation of JP 2009-37995, published Feb. 19, 2009.
English Language Machine Translation of JP 3121916, published May 10, 2006.
English Language Machine Translation of JP Publication 2005-093097 published Apr. 7, 2005.
English Language Machine Translation of JP Publication 2005-123200 published May 12, 2005.
English Language Machine translation of JP-2002-280617published Sep. 27, 2002.
English Language Machine translation of JP-2005-286267 published Oct. 13, 2005.
English Language Machine translation of JP-2006-244725 published Sep. 14, 2006.
English Language Machine Translation ofJP 2003-092022 published Mar. 28, 2003.
English Language Translation of Office Action issued in corresponding Japanese Appl 2005-221571 on Oct. 20, 2009.
English Language Translation of International Search Report for PCT/JP2008/073436 mailed Mar. 24, 2009.
English translation of Office Action issued in corresponding Japanese Appl 2005-221571 on Jul. 7, 2009.
English translation of Office Action issued in corresponding Japanese Appl 2005-221571 on Aug. 25, 2009.
English Language Translation of Office Action issued in Japanese Appl 2005-221688 on Jan. 26, 2010.
Machine English language translation of JP-2003-016808 published Jan. 17, 2003.
Office Action issued in corresponding Japanese Appl 2005-221571 on Jul. 7, 2009.
Office Action issued in corresponding Japanese Appl 2005-221571 on Aug. 25, 2009.
Office Action issued in corresponding Japanese Appl 2005-221571 on Oct. 20, 2009.
Search Report of International Application No. PCT/JP2008/068625 mailed Dec. 9, 2008.
English Language Abstract of JP 2004-193053 published Jul. 8, 2004.
English Language Abstract of JP 2-91105 published Mar. 30, 1990.
English Language Abstract of JP 2000-173303 published Jun. 23, 2000.
English Language Abstract of JP 2003-092022 published Mar. 28, 2003.
English language abstract of JP-2002-280617 published Sep. 27, 2002.
Enalish language abstract of JP-2003-016808 published Jan. 17, 2003.
English Language Abstract of 2003-59330 published Feb. 28, 2003.
English Language Abstract of JP 2005-166578 published Jun. 23, 2005.
English language abstract of JP-2005-286267 published Oct. 13, 2005.
English Language Abstract of JP 2006-040727 published Feb. 9, 2006.
English language abstract of JP-2006-244725 published Sep. 14, 2006.
English Language Abstract of JP 2008-91140 published Apr. 17, 2008.
English Language Abstract of JP 2004-006096 published Jan. 8, 2004.
Office Action issued in Japanese Appl 2005-221688 on Jan. 26, 2010.
English Language Abstract of JP 2009-37995, published Feb. 19, 2009.
English Language Abstract of JP 2000-083343, published Mar. 21, 2000.
English Language Abstract of JP 57-152706 published Sep. 21, 1982.
English Language Abstract of JP 2006-310057, published Nov. 9, 2006.
International Preliminary Report on Patentability and Written Opinion issued in PCT/JP2008/068625 mailed May 11, 2010.
Office Action issued in Japanese Appl 2005-371406 on Apr. 20, 2010.
English Translation of Office Action issued in Japanese Appl 2005-371406 on Apr. 20, 2010.
English Translation of Japanese Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.

English Language Abstract of JP 2009-135026 published Jun. 18, 2009.
English Language Translation of JP 2009-135026 published Jun. 18, 2009.
English Language Abstract of JP 2002-525814 published Aug. 13, 2002.
English Language Translation of JP 2002-525814 published Aug. 13, 2002.
English Language Abstract of JP 2003-059305 published Feb. 28, 2003.
English Language Translation of JP 2003-059305 published Feb. 28, 2003.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.
English Language Translation of JP 2007-073306 published Mar. 22, 2007.
Extended European Search Report issued in EP Appl 10006720.6 on Oct. 13, 2010.
English Language Abstract of JP 61-35216 published Feb. 2, 1086.
IPRP & WO issued in PCT/JP2008/073436 on Aug. 10, 2010.
English Language Abstract of JP 2006-156187 published Jun. 15, 2006.
English Language Translation of JP 2006-156187 published Jun. 15, 2006.
U.S. Appl. No. 13/034,959, filed Feb. 25, 2011, Pending.
U.S. Appl. No. 13/172,557, filed Jun. 29, 2011, Pending.
U.S. Appl. No. 13/221,519, filed Aug. 30, 2011, Pending.
U.S. Appl. No. 13/221,551, filed Aug. 30, 2011, Pending.
Related U.S. Appl. No. 12/885,005.
Related U.S. Appl. No. 12/933,969.
Related U.S. Appl. No. 12/885,849.
Related U.S. Appl. No. 12/886,025.
Related U.S. Appl. No. 12/886,123.
Related U.S. Appl. No. 13/044,369.
Related U.S. Appl. No. 13/034,959.
Related U.S. Appl. No. 13/172,557.
Related U.S. Appl. No. 13/221,519.
Related U.S. Appl. No. 13/221,551.
Chinese Office Action issued in CN 201010216943 on Oct. 26, 2011.
English Language Translation of Chinese Office Action issued in CN 201010216943 on Oct. 26, 2011.
English Language Abstract of CN 101307887 published Nov. 19, 2008.
English Language Translation of JP 2009/117342 published May 28, 2009.
English Language Abstract of JP 2009/117342 published May 28, 2009.
English Language Abstract of JP 2004-119078 published Apr. 15, 2004.
English Language Translation of JP 2004-119078 published Apr. 15, 2004.
Chinese Office Action issued in CN 201010121809.11 on Mar. 31, 2012.
English Translation of Chinese Office Action issued in CN 201010121809.11 on Mar. 31, 2012.
English Language Abstract and Claims of CN201149860 published Nov. 12, 2008.
Enslish Language Abstract and Claims of CN201072113 published Jun. 11, 2008.
English Language Abstract of CN2602514 published Feb. 4, 2004.
Related U.S. Appl. No. 12/825,650.
Related U.S. Appl. No. 12/794,509.
Related U.S. Appl. No. 12/794,558.
Related U.S. Appl. No. 12/811,795.
Related U.S. Appl. No. 12/713,230.
Related U.S. Appl. No. 12/825,956.
Related U.S. Appl. No. 12/845,330.
Extended European Search Report issued in EP 111560003.9 on May 18, 2011.
Extended European Search Report issued in EP 08838942.4 on Jun. 1, 2011.
English Language Abstract of JP 2008-277561 published on Nov. 13, 2008.
English Language Translation of JP 2008-277561 published on Nov. 13, 2008.
English Language Abstract of JP 2008-227412 published Sep. 25, 2008.
English Language Translation of JP 2008-227412 published Sep. 25, 2008.
Japanese Office Action issued in 2005-269017 on Jan. 13, 2011.
English Language Translation of Japanese Office Action issued in 2005-269017 on Jan. 13, 2011.
English Language Abstract of JP 2004-221042 published Aug. 5, 2004.
English Language Translation of JP 2004-221042 published Aug. 5, 2004.
English Language Abstract of JP 63-102265 published May 7, 1988.
English Language Abstract of JP 2009-206104 published Sep. 10, 2009.
English Language Translation of JP 2009-206104 published Sep. 10, 2009.
European Search Report issued in EP 10178361.1 on Jul. 4, 2011.
U.S. Appl. No. 13/172,557.
U.S. Appl. No. 13/221,519.
U.S. Appl. No. 13/221,551.
Related U.S. Appl. No. 12/794,379.
Related U.S. Appl. No. 12/794,429.
Related U.S. Appl. No. 12/794,476.
Related U.S. Appl. No. 12/738,081.
Related U.S. Appl. No. 12/880,490.

* cited by examiner

LAMP AND LIGHTING EQUIPMENT WITH THERMALLY CONDUCTIVE SUBSTRATE AND BODY

CROSS-REFERENCE TO RELATED APPLICATION

This application is based upon and claims the benefit of priority from prior Japanese Patent Application No. 2009-220433, filed Sep. 25, 2009, the entire contents of which are incorporated herein by reference.

FIELD

The present invention relates to a lamp having a base in which light emitting elements, such as light emitting diodes are used as a light source.

BACKGROUND

Recently, a lamp using a semiconductor light emitting element with little power consumption and long life has been used in place of a filament type lamp as a light source for various lighting equipments. As for the light emitting diode, the output light is decreased with the temperature of the diode while operation, which results in short life of the diode. Therefore, it is requested to suppress an increase in the temperature. For example, Japanese Patent Application Laid Open No. 2008-91140 discloses an LED lamp using the light emitting diode in which a cover (base body) and a base plate are made from aluminum having thermally conductive characteristic. Heat generated in the lighting operation is conducted to the base plate from a wiring substrate where the lighting diodes are mounted, and then from the base plate to the base body to radiate the heat.

However, according to the lamp disclosed in the patent application, the base plate is provided between the wiring substrate on which the lighting diodes are mounted and the base body formed of aluminum. Therefore, the heat resistance is increased, and it becomes difficult to conduct the heat generated by the lighting diode to the base body made from metal. Especially, the base plate is made from of a thick aluminum plate to work as a heat sink, which results in more increase in the heat resistance and the manufacturing cost.

The embodiments supply a lamp with a base and a lighting equipment using the lamp in which the heat resistance between the lighting diodes and the base body is decreased, and the heat generated by the lighting diode can be more easily conducted to the base body.

BRIEF DESCRIPTION OF THE DRAWINGS

The accompanying drawings, which are incorporated in and constitute a portion of the specification, illustrate embodiments of the invention, and together with the general description given above and the detailed description of the embodiments given below, serve to explain the principle of the invention.

DETAILED DESCRIPTION

Figure 1A:
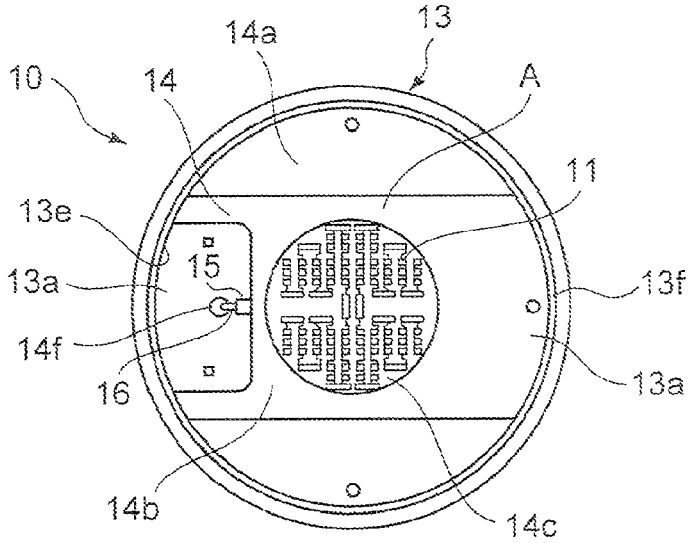
FIG. 1A shows a lamp with a base according to a first embodiment of the present invention, specifically a top plan view in a state in which a cover element is removed.

A lamp with a base and a lighting equipment according to an exemplary embodiment of the present invention will now be described with reference to the accompanying drawings wherein the same or like reference numerals designate the same or corresponding portions throughout the several views.

According to one embodiment, a lamp with a base includes a thermal conductive hollow base body having a first end portion and a second end portion, including a concave container portion, an opening portion formed at the first end portion so as to communicate with the container portion and a substrate support portion formed at a peripheral portion of the opening portion; a substrate formed of one of a thermal conductive metal plate and a thermal conductive insulating substrate having a first surface and a second surface, and including a semiconductor lighting element mounted on the first surface, a peripheral portion of the second surface of the substrate being fixed to the substrate support portion so as to cover the opening portion in a thermally conductive state therebetween; a power supply device accommodated in the container portion of the base body to light on the semiconductor lighting element; and a base provided at the second end portion side of the base body and electrically connected with the power supply device.

[First Embodiment]

The lamp with the base according to the first embodiment constitutes a mini krypton lamp, as shown in FIG. 1A, FIG. 1B, FIG. 2A, and FIG. 2B. The lamp 10 includes a semiconductor light emitting element 11, a power supply device 12 to turn on the semiconductor light emitting element 11, a base body 13 having a substrate support portion at its one end, a substrate 14 to mount the semiconductor light emitting element 11, a base 17 provided in the other end portion of the base body 13, and a cover element 18.

In this embodiment, the light emitting diodes (hereafter called as "LED") having high intensity and high output characteristics constitute the semiconductor light emitting element 11. A plurality of LED chips having the same characteristics are prepared. The light emitted from blue LED chips and the light emitted from yellow phosphor excited by the blue light generate a white color. Most of white color is emitted in a direction of a light axis of the LED chip. Here, the light axis is a direction approximately perpendicular to the surface of the substrate 14 on which the LED 11 is mounted.

As for the semiconductor light emitting element 11, it is preferable that white color emits. However, red, blue, green and other colors combining various kinds of colors may emit according to the use of the lighting equipment. Moreover, the light emitting element 11 may be constituted by not only the light emitting diode but a semiconductor laser, an organic electroluminescence, etc. as the light source.

The power supply device 12 which turns on the LED 11 includes a tabular circuit board 12*a* which mounts circuit parts to form a lighting circuit for above-mentioned LED 11. The lighting circuit is constituted so that the circuit converts an alternating voltage of 100V to a direct voltage of 24 V, and supplies a constant current to the respective LEDs 11. A circuit pattern is formed on one surface or both surfaces of the circuit board 12*a* formed in the tabular shape. Furthermore, a plurality of small type electrical parts, such as lead parts, for example, an electrolytic condenser and chip parts as transistors are mounted on the surfaces of the circuit board 12*a*. The circuit board 12*a* is accommodated in an insulating case 20 fitted to a container portion 13*c* of the base body 13 so that the circuit board 12*a* is arranged in a vertical direction. Consequently, the power supply device 12 to light on the LED 11 is accommodated in a container portion 13*c* of the base body 13. A lead wire 16 is connected with an output terminal of the circuit board 12*a* to supply the current to the LED 11, and an input wire (not illustrated) is connected with an input terminal of the circuit board 12*a*. In addition, the power supply device 12 may include a modulator for modulating the semiconductor light emitting elements 11.

In this embodiment, the base body 13 is formed of a thermally good conductive metal such as aluminum in a hollow-like cylinder shape. The shape of the lateral cross-section of the base body 13 is formed in an approximately round shape. The container portion 13*c* constituted by a cave, which includes a large opening 13*a* at one end portion and a small opening 13*b* at the other end portion, is integrally formed in the base body 13. The outer surface is formed so as to make an abbreviated conic taper side in which a diameter in a lateral plane becomes smaller one by one toward the other end portion from one end portion. The outer surface is formed so that the appearance is made approximate to a silhouette of a neck assembly in a mini krypton electric bulb. A plurality of radiating fins 13*d* projecting from the one end portion to the other end portion are formed in a radical pattern. The base body 13 is formed into a cylinder object having the cave inside by process of casting, forging, or cutting.

A substrate support portion 13*e* which makes a shape of a ring-like stage on an inner circumference edge of the large opening 13*a* at one end portion of the base body 13 is integrally formed so that the circular concave portion is formed in the opening 13*a*. Further, a protrusion portion 13*f* of a shape of a ring is integrally formed around the concave portion. The surface of the substrate support portion 13*e* in a stage shape is formed smooth, and the COB (Chip On Board) module A to be described later is arranged on the substrate support portion 13*e* so as to stick to the surface of the substrate support portion 13*e* directly.

Thereby, the opening 13*a* communicating with the container portion 13*c* is formed at the end portion of the base body 13. Consequently, the thermally conductive hollow-like base body 13 having the substrate supporting portion 13*e* at the circumference of the opening 13*a* is formed.

The power supply device 12 is installed in the container portion 13*c* formed in the cave of the hollow-like base body 13. The horizontal cross-sectional view of the base body 13 is approximately circular having a center axis x-x. Moreover, the inner surface of the base body 13 is formed so that the inner surface is made along the outer taper surface of the approximately truncated cone shape in which the diameter of the inner surface becomes smaller one by one toward the other end portion from one end portion. The insulating case 20 to electrically isolate between the power supply device 12 and the base body 13 made from aluminum is fitted to the container portion 13*c*.

It is preferable that the base body 13 is made of a high thermally conductive metal including at least one of aluminum (Al), copper (Cu), iron (Fe), and nickel (Ni). In addition, industrial materials, such as nitride aluminum (AlN) and silicon carbide (SiC) may be used. Furthermore, synthetic resins, such as high thermally conductive resins may be also used. It is preferable the outer surface of the base body 13 is formed approximate to a silhouette of the neck assembly in a common filament lamp, specifically, in which the diameter of the taper side of the approximately truncated cone becomes smaller one by one toward the other end portion from one end portion, because the variation to apply the lamp to lighting equipments is increased. However, the form of the lamp is not necessarily required for making the common filament lamp resemble and can be variously changed according to the use. The base body 13 is made integrally or by assembling some parts manufactured separately. For example, first, a portion to support the substrate 14 and a portion to arrange a concave container portion 13*c* are manufactured separately, and then the portions are assembled in one.

The insulating case 20 is formed of synthetic resins with heat resistance and electrical insulation characteristics, such as PBT (poly-butylene-terephthalate). The insulating case 20 includes a large opening 20*a* at one end portion and a small opening 20*b* at the other end portion, and is formed in a cylinder shape so as to fit to the inner surface of the container portion 13*c*, that is, the approximately truncated cone shape in which the diameter of the taper side becomes smaller one by one toward the other end portion from one end portion. The insulating case 20 is fixed in the container portion 13*c* by screws or adhesives such as silicone resin and epoxy resin. It is also possible to fix the insulating case 20 by fitting in the container portion 13*c*. A projected locking portion 20*c* is integrally formed in the perimeter outer surface of the insulating case 20 located in an interstitial region of the outer surface in a ring-like sword guard shape. The perimeter outer surface of the insulating case 20 projected from the locking portion 20*c* toward down side in the figure is made stage-like to form a base attachment portion 20*d*.

In this embodiment, the substrate 14 is formed of a thermally conductive metal plate, such as a thin plate of aluminum of 0.5 mm-2 mm. A thin electrically insulating film, such as white glass epoxy material is formed on the surface 14*a* of the substrate 14. Further, an insulating layer 14*b*, such as glass epoxy and silicone having a shallow circular concave container portion 14*c* is formed on the thin insulating film. A wiring pattern of a copper film is formed on the bottom of the concave container portion 14*c*, that is, the surface of the insulating film on the substrate 14.

A plurality of LEDs 11 (blue LED chips) are mounted in a matrix on the substrate 14, adjacent to the circuit pattern in the container concave portion 14*c* of the substrate 14 using the COB (Chip On Board) technology. Moreover, each blue LED chip 11 regularly arranged in the shape of the approximate matrix is connected in series by connecting the adjoining LED chips 11 using a bonding wire. Furthermore, a seal element 14*d* in which yellow phosphor is distributed and mixed is coated or embedded in the container concave portion 14*c* of the substrate 14. The seal element 14*d* converts the blue light emitted from the blue LED chip 11 into yellow light by exiting the yellow phosphor by the blue light while partially passing the blue light emitted from the blue LED chip 11. Consequently, the white light is emitted by mixing the passing blue light and the exited yellow light. As mentioned above, the substrate 14 is constituted by the COB module A in which the plurality of LEDs 11 are mounted on the surface 14*a* of the substrate 14. In addition, a through-hole 14*f* is formed for penetrating the lead wire 16 for electric supply in a perimeter edge side of the substrate 14.

Figure 2A:
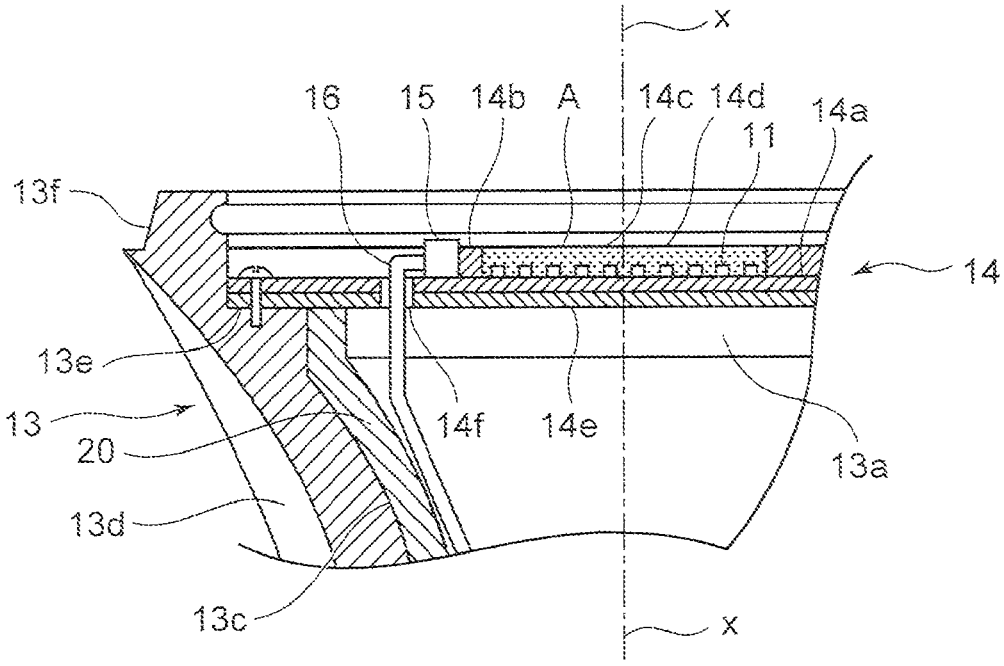
FIG. 2A shows a support portion of a substrate in the lamp according to the first embodiment shown in FIG. 1A, specifically a cross-sectional view of a main portion by enlarging.
Figure 2B:
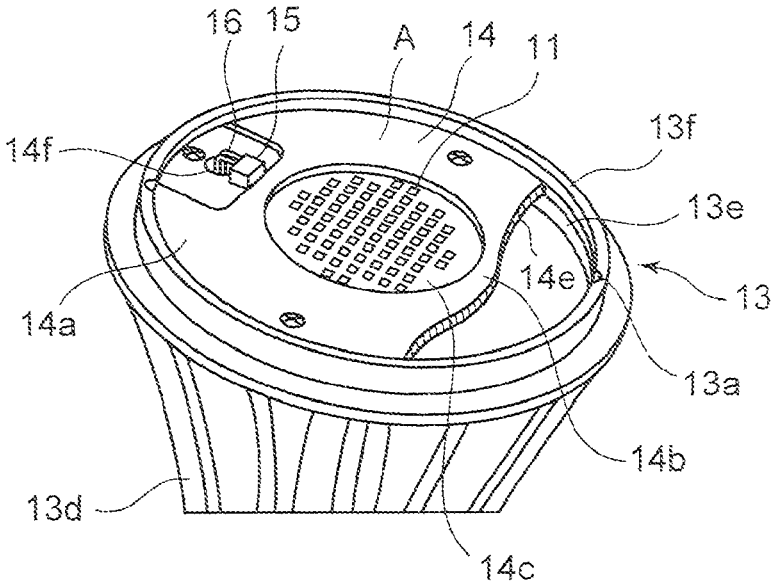
FIG. 2B shows a perspective view by cutting the substrate partially.

The substrate 14 formed of aluminum as constituted above is arranged on the base body 13 so that the perimeter edge portion of the back surface 14*e* of the substrate 14 is directly attached to the substrate support portion 13*e* of the base body 13 in a thermally good conductive condition. As shown in FIG. 2A, the substrate 14 is arranged so that the surface side 14*a* of the substrate 14 on which the LEDs 11 are mounted may face outside and is fixed on the flat substrate support portion 13*e* of the base body 13 at the perimeter edge of the back surface 14*e* using fixing means, such as screws to adhere each other.

Thereby, the metal substrate 14 is constituted, in which the LEDs 11 are mounted on the surface side 14*a*, and a back side peripheral portion is fixed to the substrate support portion 13*e* of the base body 13 in a thermally good condition so as to cover the opening 13*a* of the base body 13.

According to above structure, the back surface 14*e* of the substrate 14 is surely adhered to the substrate support portion 13*e*. Further, since the substrate 14 is formed of thermally conductive metal, such as aluminum, it becomes possible to dissipate the heat generated in the LEDs 11 by effectively conducting the heat to the base body 13. The optic axis of the COB module constituted by the substrate 14 equipped with LEDs 11 is aligned with the central axis x-x of the base body 13. Consequently, a light source having a flat light emitting face of an approximately round shape is formed over all.

The metal substrate 14 is the component for mounting the semiconductor light emitting element 11 as a light source and is formed of a thermally good conductive metal, for example, aluminum, copper, stainless steel, etc. The wiring pattern is formed on the metal substrate 14 through an electrically insulating layer, such as silicone resin, and the semiconductor light emitting elements 11 are formed on the circuit pattern. However, other mounting methods are applicable. Further, the form of the substrate 14 may be circle, polygon, such as quadrangle and hexagon, ellipse, and various forms are applicable for achieving the preferable characteristics.

A small type connector 15 is provided on the substrate 14. An output terminal of the connector 15 is connected with an input terminal of the wiring pattern by which the LEDs 11 are connected in series, for example, by soldering. The connector 15 is simultaneously fixed on the substrate 14 by the soldering. Accordingly, the connector 15 is arranged on the substrate close to the through-hole 14*f* and is electrically connected to each LED 11 mounted on the surface side 14*a* of the substrate 14. The electric wire 16 for electric supply connected to the output terminal of the above-mentioned power supply device 12 is put into an input terminal hole of the connector 15. The electric wire 16 is formed of a lead with two thin cores in which an electric insulating covering is respectively made so as to be penetrated into the through-hole 14*f*.

Figure 1B:
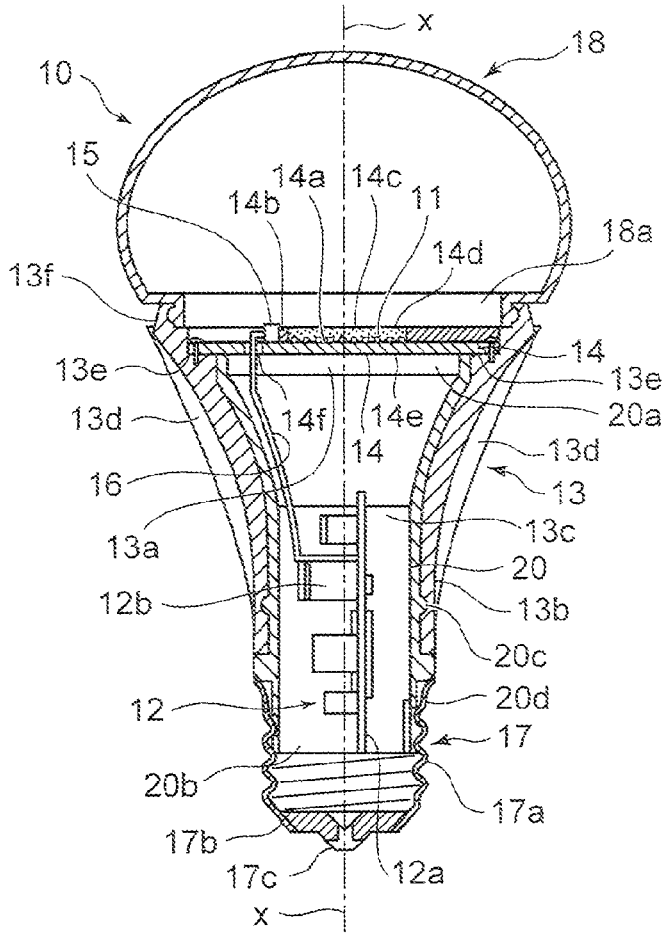
FIG. 1B shows a cross-sectional view.

As shown in FIG. 1B, the base 17 provided at the other end portion of the base body 13 is formed in an Edison E17 type and includes a cylindrical shell portion 17*a* made from a copper plate and equipped with a screw thread, and an electrical conductive eyelet portion 17*c* provided in a top portion of the lower end of the cylindrical shell portion 17*a* through an insulating portion 17*b*. The opening portion of the shell portion 17*a* is fitted to a base attachment portion 20*d* of the insulating case 20 from outside and is adhered by adhesives or caulking. Thereby, the electric insulation between the base body 13 and the base 17 formed of aluminum is carried out. A pair of input cables (not shown) drawn from the input terminal of the circuit board 12*a* is connected to the shell portion 17*a* and the eyelet portion 17*c* of the base 17.

In this embodiment, the same base 17 as that of the common filament lamp is used. Therefore, the LED lamp according to this embodiment can be screwed to the same socket for a filament lamp. Edison types E26 and E17 bases which are widely used are suitable for the base 17 of the embodiment. The whole base 17 may be formed of metal, or only a connecting portion of the base 17 may be made of the metal plate such as copper in which other portion is made of resin. Furthermore, the base 17 may include a pin type terminal used for a fluorescence lamp or a terminal of L character type used for a hooking ceiling. Therefore, the base 17 is not limited to a specific one.

A globe 18 constituting a transparent cover is formed of, for example, transparent glass or synthetic resin with thin thickness. Here, the globe 18 is formed of polycarbonate of milk white color which is translucent and optically diffusible. The globe 18 is formed in a shape approximated to the silhouette of the ball portion of the filament type mini krypton lamp having an opening 18*a* at an end portion with a smooth curved surface. The globe 18 is attached to the base body 13 so as to cover the light face 14*a* of the substrate 14 constituted by the COA module. The globe 18 is fitted to the projected portion 13*f* of the substrate support portion 13*e* and is fixed with adhesives, such as silicone resin and epoxy resin. Thereby, the lamp 10 with the globe 18 at one end portion and the base of E26 type or E17 type at the other end portion of the base body 13 is constituted. The whole appearance of the lamp 10 is approximated to the silhouette of the mini krypton lamp, in which the sloping peripheral surface of the base body 13 is connected with the peripheral surface of the globe 18.

Next, an assembly process of the lamp 10 with a base constituted above is explained. First, the insulating case 20 is fitted to the concave container portion 13*c* of the base body 13 from the large opening 13*a* at the end of the base body 13 and is fixed by coating adhesives at a contact portion between the outer surface of the insulating case 20 and the inner surface of the container portion 13*c*. At this time, the insulating case 20 is set so that the large opening portion 20*a* of the insulating case 20 is located at the same level as the step portion of the substrate support portion 13*e* or a little bit lower than the step portion. The substrate 4 prevents the insulating case 20 from shifting. The insulating case 20 may be fixed by pressing the insulating case 20 with the substrate 14 without coating adhesives between the external surface of the insulating case 20 and the inner surface of the container portion 13*c*

Next, the circuit board 12*a* of the power supply device 12 is inserted into the insulating case 20 from the large opening 20*a* of the insulating case 20 in a vertical direction and is accommodated in the container portion 13*c* by fitting to guide slots. At this time, the tip of the lead wire 16 for power supplying which is connected with the output terminal of the circuit board 12*a* is kept to be pulled out from the large opening 20*a* outside.

Then, the lead wire 16 for power supply pulled out from the opening 20*a* is penetrated in the through-hole 14*f* from the back surface 14*e* of the substrate 14, and a tip of the lead 16 is pulled to the surface side 14*a* of the substrate 14.

Next, the peripheral edge of the substrate 14 is arranged on the flat substrate support portion 13*e* in the stage shape so as to cover the whole opening 13*a* of the base body 13. The surface side 14*a* of the substrate 14 on which the LEDs 11 are mounted is arranged so as to face outside. The substrate 14 is fixed to the substrate support portion 13*e* by four screws.

Furthermore, the insulating cover of the tip of the lead wire 16 pulled out from through-hole 14*f* is removed. The lead wire 16 is connected with the connector 15 by inserting the tip of the lead wire 16 to the connector 15.

Next, an input cable (not shown) drawn from the input terminal of the circuit board 12*a* of the power supply device 12 is connected with the shell portion 17*a* and the eyelet portion 17*c* of the base 17. In the connected state, the opening of the shell portion 17*a* is fitted to the base fixing portion 20*d* of the insulating case 20 and is fixed with adhesives while the input cable is connected. Then the peripheral edge of the opening 18*a* of the cover component 18 is fitted to the protrusion portion 13*f* of the base body 13 and is fixed by coating adhesives at a contact portion with the protrusion portion 13*f* so as to cover the LED 11 mounted on the substrate 14. Thereby, the small lamp 10 with the base having the cover, that is, the globe 18 at one end portion, and the base of E17 type at the other end portion of the base body 13 is constituted. The whole appearance of the lamp 10 is approximated to the silhouette of the filament type mini krypton lamp.

As mentioned above, according to this embodiment, since a plurality of LEDs 11 are regularly mounted on the surface side 14*a* of the substrate 14 in the matrix shape by the OCB, the light is uniformly emitted from the respective LEDs 11 toward the whole inner surface of the globe 18 and is diffused by the milky glove 18. Thereby, the lighting having characteristics of the LED lamp approximated to the mini krypton electric bulb can be performed.

Moreover, the heat generated in each LED 11 is conducted from the substrate 14 made from aluminum to the substrate support portion 13*e* fixed to the substrate 14 and is effectively radiated through the radiating fin 13*d* of the base body 13 to outside. In this embodiment, the base substrate for heat radiation made from aluminum is not provided between the substrate 14 equipped with the LEDs 11 and the base body 13 as shown in the prior patent application. Therefore, it becomes possible to radiate more effectively the heat generated by the LEDs without increasing the heat resistance due to the additional part, that is, the base substrate.

Furthermore, since the aluminum substrate 14 is constituted as the COB module in which a plurality of LEDs are mounted on one surface; a lighting approximated to the mini krypton electric bulb as mentioned above is achieved, while being able to control the rising of temperature of the LED 11 by making the heat resistance between the LEDs 11 and the base body 13 small, which results in effective radiating operation.

According to the effective radiating operation, the rising and unevenness of the temperature of the respective LEDs 11 are prevented, and lowering of the lighting efficiency is suppressed. Furthermore, the lowering of the lighting intensity due to a light flux fall can be prevented, and it becomes possible to supply a lamp with a base which can fully obtain almost the same light flux as a filament lamp, while obtaining long life of the lamp. In addition, it becomes possible to supply a lamp with a base and a lighting equipment which are also advantageous in the manufacturing cost because the effective heat dissipation is carried out without using the additional base substrate as mentioned in the prior patent application.

Moreover, as for the assembly of the lamp with the base, all the processes, such as, the fitting process to fit the insulating case 20 to the base body 13, the equipping process to accommodate the circuit board 12*a* of the power supply device 12 in the insulating case 20, the fixing process to fix the substrate 14 to the substrate support portion 13*e*, and the connecting process to connect the lead wire 16 with the connector 15 are carried out at the large opening 13*a* side of the base body 13. Therefore, the processes can be automated, which results in more manufacturing cost down.

The substrate 14 is arrange on the substrate support portion 13*e* with the ring-like stage provided in the peripheral portion of the large opening 13*a* of the base body 13 so as to adhere directly. Accordingly, the base body 13 is formed to have a cave of the shape of a hollow in which the inner circumference side of the base body 13 is formed in a circular truncated cone shape having one end portion larger than the other end portion along the tapered outer circumference surface, which results in weight saving of the base body 13. Furthermore, since a large space for accommodating the power supply device 12 in the cave is formed, it becomes possible to comply with an enlarged power supply device 12 to obtain high output.

Moreover, the peripheral portion of the back surface 14*e* of the substrate 14 may be adhered to the stage-like substrate support portion 13*e* by thermally good conductive adhesives, such as silicone resin and epoxy resin provided therebetween. Thereby, the more steady electrical isolation between the base body 14 and the substrate support portion 13*e* is achieved according to above adhesive while being attached more firmly by preventing generation of the gap between the substrate 14 and the substrate support portion 13*e*.

In addition, the surface portion of the base body 13 exposed to outside may be formed, for example, in a minute concave-convex shape or in a satin shape to enlarge the surface portion, and white painting or white alumite treatment may be also performed to raise the thermal emissivity of the surface portion. In the case where the white alumite treatment is performed, and metallic silver color or white color is painted on the surface of the outer surface like the embodiments, the reflectance of the external surface of the base body 13 made of aluminum exposed outside becomes higher when the lighting equipment 20 equipped with the LED lamp 10 is turned on. Furthermore, the appearance and design of the lamp becomes more attractive. Accordingly, it becomes possible to raise both the light emission ratio of the lighting equipment and marketability. Moreover, the globe 18 may be constituted by a transparent or a translucent protective cover for protecting the wiring portion of LEDs 11 from the exterior.

[Second Embodiment]

Figure 3:
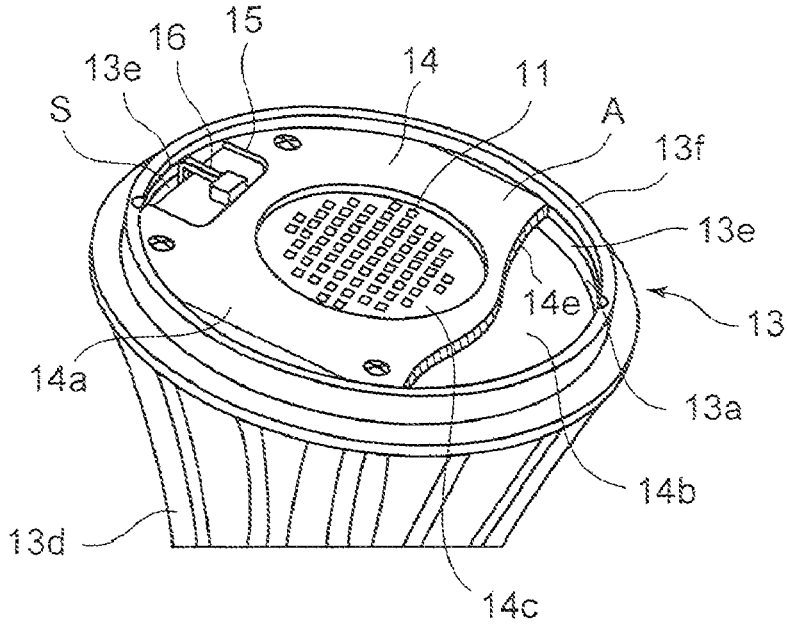
FIG. 3 shows a perspective view of the substrate support portion in a lamp with a base according to a second embodiment of the present invention by cutting the substrate partially.

As mentioned above, in the first embodiment, the substrate 14 is formed of a thin plate made from aluminum in the shape of a disk. However, in this embodiment, the substrate 14 is formed of a plate of an approximately square shape in which four corners are cut as shown in FIG. 3. According to the structure, a space is generated between the cut linear portion and the ring-like substrate support portion 13*e*. The end portion of the lead wire 16 can be inserted in the space S and is connected with the connector 15. According to this embodiment, the process to form the through-hole 14*f* is not needed, which results in advantageous feature in the manufacturing cost.

[Third Embodiment]

Figure 4:
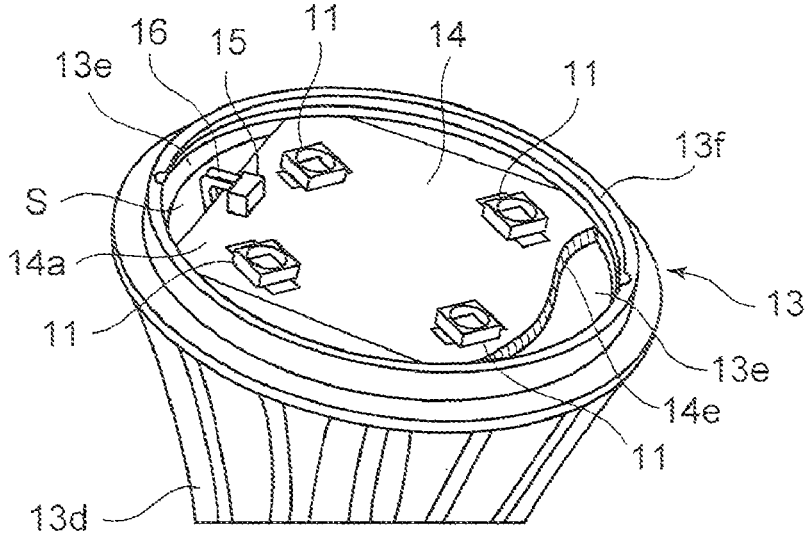
FIG. 4 shows a perspective view of the substrate support portion in a lamp with a base according to a third embodiment of the present invention by cutting the substrate partially.

Although the substrate 14 is constituted by the COB module A in the first embodiment, the substrate 14 may be constituted by an SMD package module in which the LEDs are surface mounted on the substrate 14 made from metal shown in FIG. 4. In this case, for example, the substrate 14 is made from aluminum, and the circuit pattern formed of a copper film is formed through an electric insulating layer, such as silicone resin. Four LEDs 11 are mounted on the circuit pattern in an approximately concentric circle with regular intervals. In addition, each LED 11 is connected in series by the circuit pattern.

The substrate 14 constituted by the SMD package module is directly attached to the stage-like substrate support portion 13*e* of the base body 13 by adhering. In this embodiment, the space S is formed between the cut straight line portion of the substrate 14 and the ring shaped substrate support portion 13*e* by using a plate in which four corners are cut, that is, a square shaped plate as shown in FIG. 4. Accordingly, the electric wire 16 for electric supply can be connected with the connector 15 by inserting its end in the space S.

According to this embodiment, the substrate 14 does not contact with the base body 13 at the portion where the space is formed. Therefore, the contact area therebetween decreases. However, in the case of the SMD package module, the number of the LEDs used is smaller, and the increase in the temperature is suppressed. Furthermore, each LED is arranged at a location close to the peripheral portion of the base body 13, that is, the substrate support portion 13*e*. Thereby, the heat generated by the respective LEDs 11 is effectively conducted to the substrate support portion 13*e* and is dissipated fully. Simultaneously, the process for forming the through hole 14*f* becomes unnecessary, thereby this embodiment can offer the advantageous lamp in the manufacturing cost. In addition, as for the semiconductor light emitting element 11, in the case of the SMD package module, it is preferable that a plurality of LEDs are used. However, according to this embodiment, the required number may be chosen based on the use of the lighting equipment. For example, a unit consisting of four LEDs 11 or a plurality of units may be used as the lighting source. Of course, only one LED 11 may be used.

Figure 5A:
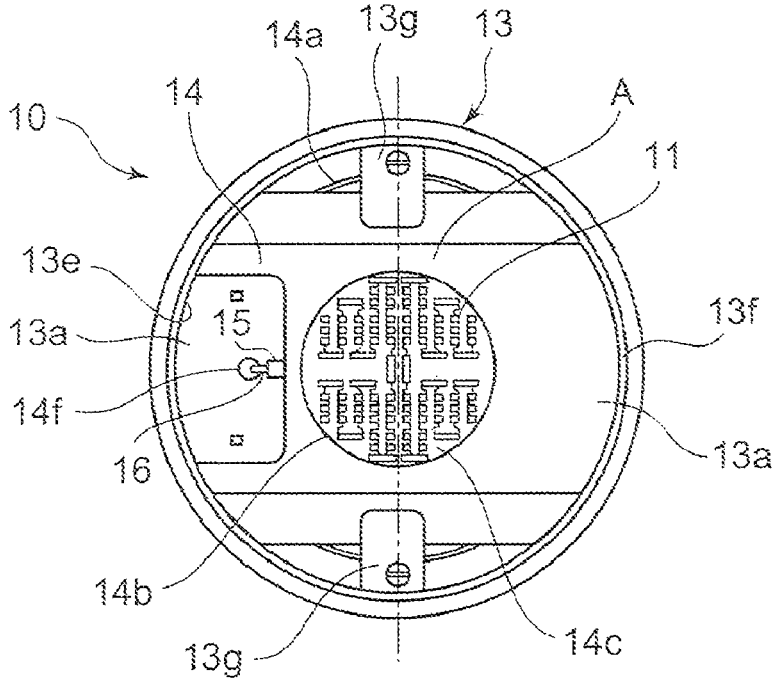
FIG. 5A shows a lamp with a base according other embodiment of the present invention, specifically a top plan view in a state in which the cover element shown in FIG. 1B is removed.
Figure 5B:
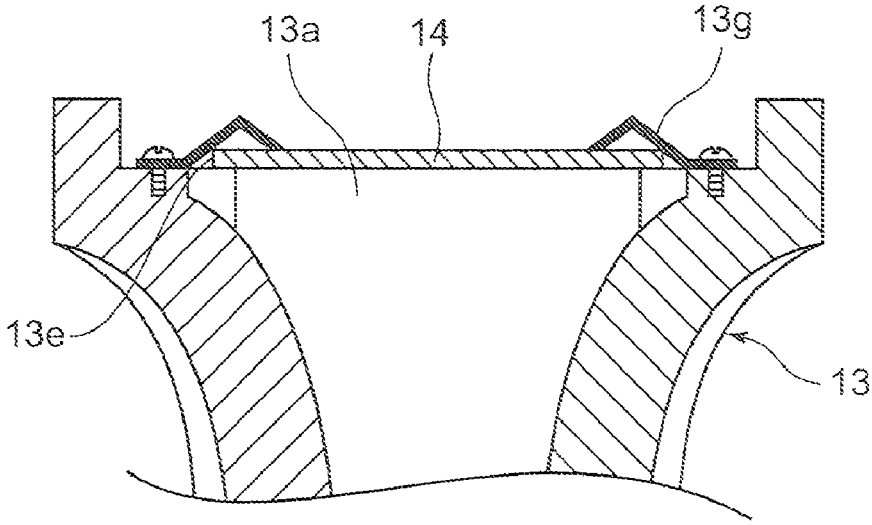
FIG. 5B schematically shows a cross-sectional view in a state in which a fixing element as shown in FIG. 5A is equipped.

In the above embodiment, although the aluminum plate is used, a ceramics substrate may be also used as a thermally conductive plate 14. However, in case the substrate 14 is fixed to the substrate support portion 13*e* by screws, a crack may be generated in the ceramics substrate 14 due to fastening torque of the screw and difference of a thermal expansion coefficient between the substrate support portion of 13*e* of aluminum and the ceramics substrate 14. The crack is not preferable for product quality. The substrate 14 can be fixed to the substrate support portion 13*e* by a fixing element 13*g* which is provided between the screw and the substrate 14. The fixing element 13*g* presses and fixes the substrate 14 using a mechanism of a spring as shown in FIG. 5A and FIG. 5B.

Figure 5C:
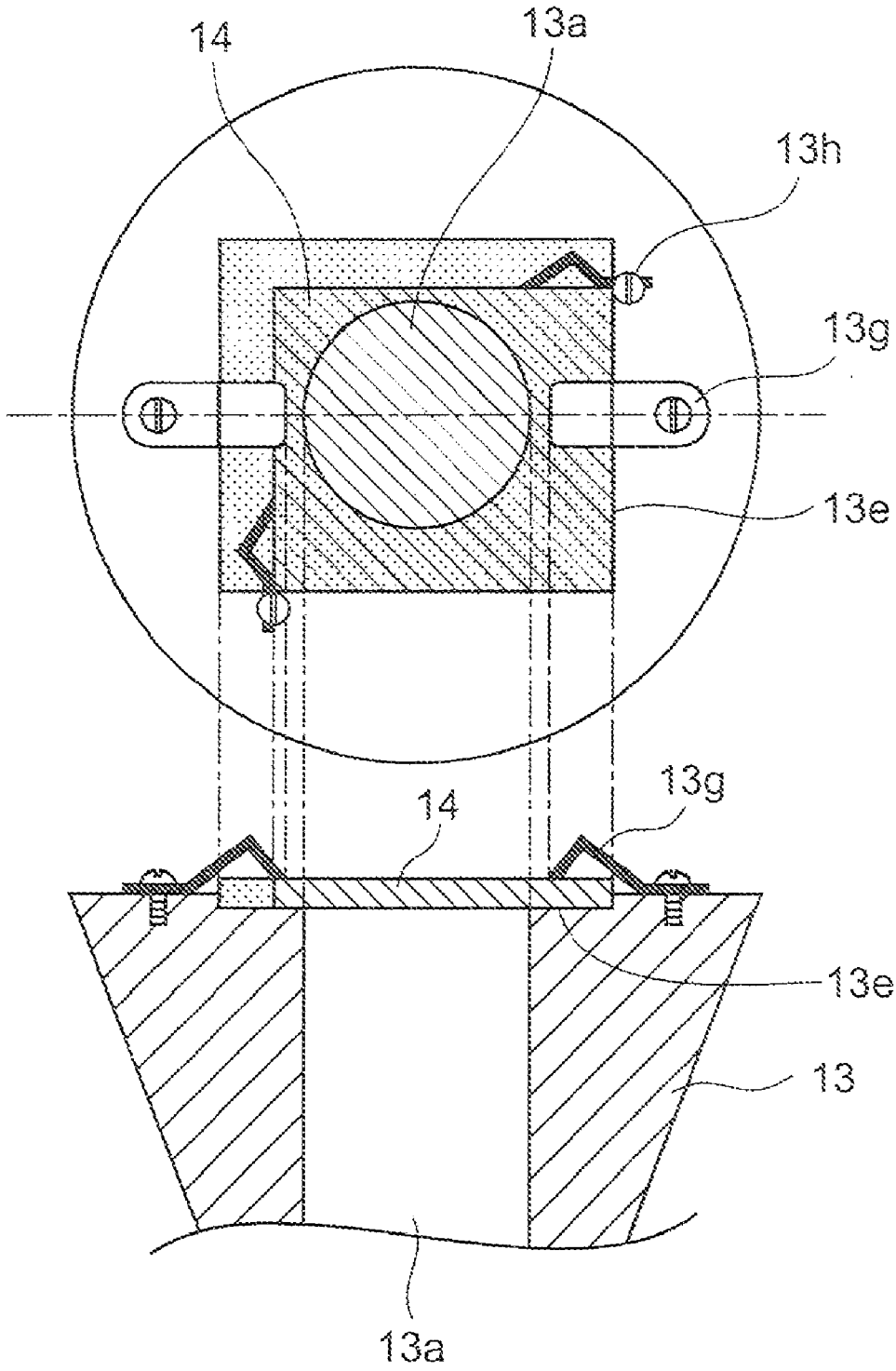
FIG. 5C schematically shows a top plan view and a cross-sectional view of a modification of the embodiment shown in FIG. 5A.

According to the fixing element 13*g*, the stress due to the difference of the thermal expansion coefficient between the substrate support portion 13*e* of aluminum and the ceramics substrate 14 is absorbed, and the generation of the crack in the substrate 14 is prevented. However, in the case the fixing element 13*g* is used, the fixed location of the substrate 14 may be gradually shifted, which results in an optical problem. Therefore, as shown in FIG. 5*c*, a stabilizer 13*h* having a similar structure to the fixing element 13*g* for pressing sides of the square shaped substrate 14 may be used together. That is, both of the fixing element 13*g* and the stabilizer 13*h* are preferably used to prevent the shifted substrate 14 from contacting with the sides of the substrate support portion of 13*e* formed in a square concave shape when every thermal expansion of the ceramics substrate 14 occurs, and from the substrate 14 being destroyed. Here, the ceramics substrate 14 is arranged on the substrate support portion 13*e* so as to have a clearance. That is, two adjacent sides of the substrate support portion 13*e* formed in the square concave shape are contacted with two sides of the ceramics substrate 14, respectively. Two stabilizers 13*h* press the other two sides of the ceramics substrate 14 to prevent the substrate 14 from laterally shifting. Consequently, the substrate 14 is fixed in a correct location without shifting. According to this structure, the ceramics substrate 14 may deform over threshold of the elastic force of the stabilizer 13*h*. However, the substrate 14 is not resulted in the destruction.

Figure 6:
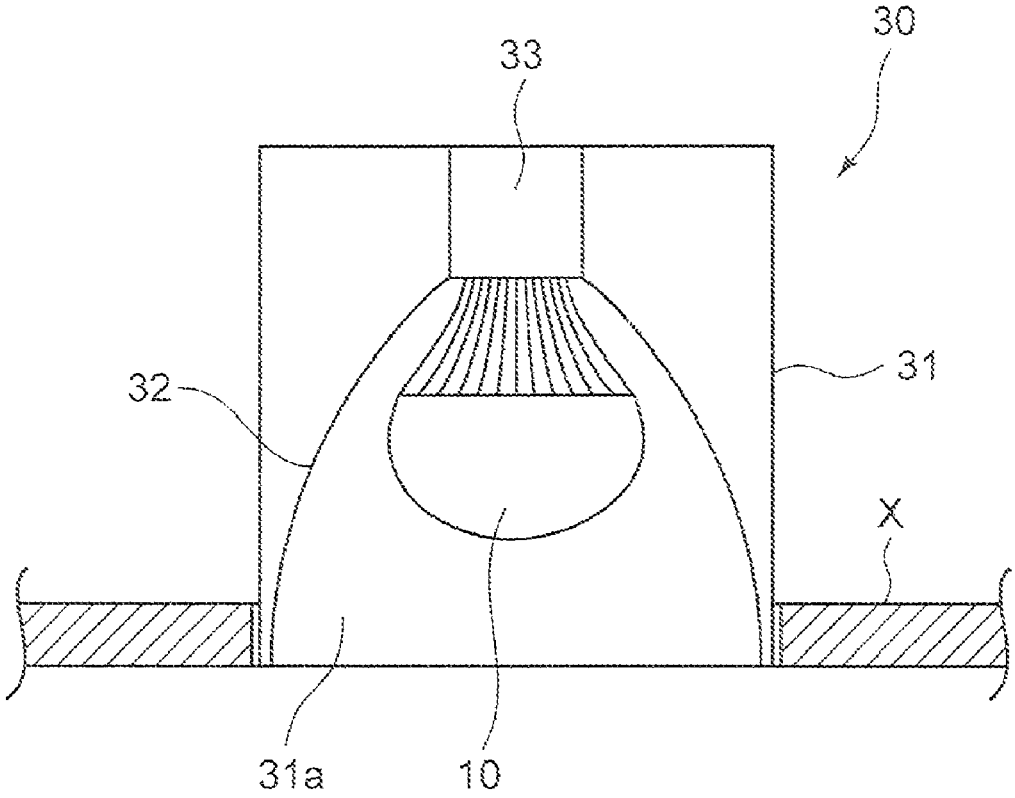
FIG. 6 is a cross-sectional view schematically showing a state in which a lighting equipment having the lamp according to the embodiments of the present invention is attached to a ceiling.

Next, a structure of a lighting equipment is explained in which the lamp 10 with the base constituted as mentioned above is used as the light source. FIG. 6 shows a down-light type equipment which is embedded in a ceiling and uses the mini krypton lamp having the E17 type base as the light source, for example, for use by store etc. The down-light type light equipment 30 includes a base case 31 made of metal with an opening 31*a* provided in a downside in a box shape, a reflector 32 made from metal fitted to the opening 31*a*, and a socket 33 to which the E17 type base of the common filament lamp is screwed. The reflector 32 is formed of, for example, metal plates, such as stainless, and the socket 33 is installed in a center portion of an upper board of the reflector 32.

In the common lighting equipment 30 for the mini krypton lamp constituted as mentioned above, the small LED lamp 10 with the base is used as a light source in place of the filament type mini krypton lamp for energy saving and extension of life. That is, since the base 17 of the LED lamp 10 is constituted in the E17 type, it is possible to screw the LED lamp 10 in the socket 33 for the common filament lamps of the above-mentioned lighting equipment without modification. Further, since the appearance of the LED lamp is constituted by the form approximated to the silhouette of the neck assembly in the mini krypton lamp by making the base body 13 of the lamp 10 with the base so as to have a substantially conic taper side, it become possible to screw the lamp 10 smoothly in the socket 33 without contacting with the reflector 32. Furthermore, it becomes possible to apply more widely the LED lamp 10 with the base to the existing lighting equipment. Accordingly, a energy-saved type down-light is constituted, in which the LED lamp with the base of the filament type is installed as the light source.

Next, an operation of the down-light using the LED lamp with the base constituted as mentioned above is explained. If power is supplied to the down-light 30 by switch, electric power is supplied through the base 17 of the LED lamp 10 from the socket 33. Then the power supply device 12 operates and outputs a direct current of 24V. The direct current voltage is applied to the LEDs 11 connected in series through the lead wire 16 connected between the output terminal of the power supply device 12 and the connector 15, and the constant direct current is applied to the LEDs 11. Thereby, each LED simultaneously lights up and emits white light when the controlled current flows into each LED 11.

Simultaneously, when the lamp 10 with the base is turned on, the LED 11 generates heat, and the temperature of LED 11 rises. The heat is conducted from the thermally conductive aluminum substrate 14 to the substrate support portion 13*e* fixed directly to the substrate 14 so as to adhere. Then the heat is effectively radiated outside through the fin 13*d* of the base body 13.

Especially, the distribution of the light from the LED lamp 10 with the base as a light source approaches to that of the light by the filament type krypton lamp. Accordingly, in the lighting equipment 30, the amount of irradiation of the light to the reflector 32 around the socket 33 increases. Thereby, even if the reflector 32 designed for the filament type mini krypton lamps is used, a lighting equipment with the same instrument characteristic as the filament type lamp and a long life can be obtained without decreasing the illuminated light when the LED lamp according to the embodiment is used as the light source.

The LED lamp with the base according to the embodiments is applied to lighting equipments, such as a down-light type embedded in the ceiling, a direct attachment type for a ceiling, a ceiling hooked type, and a wall attachment type. Moreover, the LED lamp 10 may be equipped with a globe, a shade, a reflector, etc. as an emitted light controlling means, and may be constituted so that the lighting element is exposed without the emitted light controlling means. The lighting equipment 30 is equipped with not only one lamp but also two or more lamps. Furthermore, the lighting equipment according to the embodiments is also applicable to a large-sized lighting equipment for an institution and use for offices, etc.

In the embodiments, the LED lamp with the base may be constituted so as to be approximated to the shape of the common filament lamp, such as an electric bulb form (A type or PS type), a reflex form (R type), a ball form (G type), and a cylinder form (T type), etc. In addition, the LED lamp 10 may be constituted without the globe (globe less type). Moreover, the present invention is applicable not only to the lamp with the base approximated to the form of a common filament lamp but the LED lamp which, in addition to above, makes various kinds of appearance forms and uses.

While certain embodiments have been described, these embodiments have been presented by way of example only, and are not intended to limit the scope of the inventions. In practice, the structural elements can be modified without departing from the spirit of the invention. Various embodiments can be made by properly combining the structural elements disclosed in the embodiments. For example, some structural elements may be omitted from all the structural elements disclosed in the embodiments. Furthermore, structural elements in different embodiments may properly be combined. The accompanying claims and their equivalents are intended to cover such forms or modifications as would fall with the scope and spirit of the inventions.

What is claimed is:

1. A lamp, comprising:

a thermally conductive hollow base body having a first end portion and a second end portion, including a concave container portion, an opening portion formed at the first end portion so as to communicate with the container portion and a substrate support portion formed at the opening portion;

a substrate formed of a thermally conductive metal plate having a first surface and a second surface opposing to the first surface, and including a semiconductor lighting element mounted on the first surface, a peripheral portion of the second surface of the substrate being fixed to the substrate support portion of the base body;

a power supply device accommodated in the container portion of the base body to light on the semiconductor lighting element; and a base provided at the second end portion side of the base body and electrically connected with the power supply device;

wherein a metal portion of the thermally conductive metal plate thermally contacts with the substrate support portion.

2. The lamp according to claim 1, wherein the substrate is formed of a COB (Chip On Board) module having the semiconductor lighting element on the first surface.

3. The lamp according to claim 1, wherein the substrate is formed of a SMD (Surface Mount Device) module having the semiconductor lighting element on the first surface.

4. The lamp according to claim 1, further comprising an insulating case fitted to the container portion of the base body and having an opening portion.

5. The lamp according to claim 4, wherein the substrate support portion is arranged in a substantially same plane as the opening portion of the insulating case.

6. The lamp according to claim 4, wherein the power supply device includes a circuit board accommodated in the insulating case.

7. The lamp according to claim 1, wherein the lamp is compatible to a mini krypton filament bulb.

8. The lamp according to claim 1, further comprising a cover element provided at the first end portion of the base body to cover the substrate, wherein the cover element, the base and the base provided at the second end portion side of the base body form a hole appearance of a lamp approximated to a silhouette of a filament lamp (PS type).

9. The lamp according to claim 8, the base includes a shell portion and an eyelet portion.

10. A lamp, comprising:

a thermally conductive hollow base body formed in a circular truncated cone shape having a first end portion and a second end portion smaller than the first end portion, and including a concave container portion having an opening portion formed at the first end portion so as to communicate with the container portion and a substrate support portion formed at the opening portion;

a substrate formed of a thermally conductive metal plate having a first surface and a second surface opposing to the first surface, and including a semiconductor lighting element mounted on the first surface, a peripheral portion of the second surface of the substrate being fixed to the substrate support portion;

an insulating case fitted to the container portion;

a power supply device accommodated in the insulating case to light on the semiconductor lighting element; and a base provided at the second end portion side of the base body and electrically connected with the power supply device;

wherein a metal portion of the thermally conductive metal plate thermally contacts with the substrate support portion.

11. The lamp according to claim 10, wherein the substrate is formed of a polygonal shape, and the substrate is arranged so as to have a space between the base body and the substrate.

12. The lamp according to claim 11, wherein an output wire pulled out from the power supply device extends to the first surface of the substrate and is connected with the light emitting element through the space.

13. The lamp according to claim 10, further comprising a cover element provided at the first end portion of the base body to cover the substrate. wherein the cover element, the base body and the base provided at the second end portion side of the base body form a whole appearance of a lamp approximated to a silhouette of a filament lamp (PS type).

14. The lamp according to claim 13, wherein the lamp is compatible to a mini krypton filament bulb.

15. A lighting equipment having a lamp and a socket, the lamp comprising:

a thermally conductive hollow base body having a first end portion and a second end portion, including a concave container portion, an opening portion formed at the first end portion so as to communicate with the container portion and a substrate support portion formed at the opening portion;

a substrate formed of a thermally conductive metal plate having a first surface and a second surface, and including a semiconductor lighting element mounted on the first surface, a peripheral portion of the second surface of the substrate being fixed to the substrate support portion;

a power supply device accommodated in the container portion of the base body to light on the semiconductor lighting element; and a base provided at the second end portion side of the base body and electrically connected with the power supply device;

wherein a metal portion of the thermally conductive metal plate thermally contacts with the substrate support portion.

16. The lighting equipment according to claim 15, wherein the substrate is formed of a COB (Chip On Board) module having the semiconductor lighting element on the first surface.

17. The lighting equipment according to claim 15, wherein the substrate is formed of a SMD (Surface Mount Device) module having the semiconductor lighting element on the first surface.

18. The lighting equipment according to claim 15, wherein the hollow base body is formed so that the first end portion is larger than the second end portion to form a circular truncated cone outer shape.

19. A lamp according to claim 1, wherein:

the substrate support portion is formed at peripheral portion of the opening portion; and the peripheral portion of the second surface of the substrate is fixed to the substrate support portion of the base body so as to cover the opening portion in a thermally conductive state therebetween.

20. A lamp, comprising:

a thermally conductive hollow base body having a first end portion and a second end portion, including a concave container portion, an opening portion formed at the first end portion so as to communicate with the container portion and a substrate support portion formed at the opening portion;

a substrate formed of a thermally conductive insulating plate having a first surface and a second surface opposing to the first surface, and including a semiconductor lighting element mounted on the first surface, a peripheral portion of the second surface of the substrate being fixed to the substrate support portion of the base body;

a power supply device accommodated in the container portion of the base body to light on the semiconductor lighting element; and a base provided at the second end portion side of the base body and electrically connected with the power supply device;

wherein a thermally conductive portion of the thermal conductive Insulating plate thermally contacts with the substrate support portion.

21. A lamp according to claim 20, wherein the substrate is formed of a thermally conductive ceramics substrate and the ceramics portion contacts with the substrate support portion.

22. A lamp according to claim 21, further comprising a fixing element which fixes the substrate to the substrate support portion.

23. A lamp according to claim 22, further comprising a stabilizer which presses a side of the substrate formed of the thermal conductive insulating plate.

* * * * *